US006951172B2

(12) United States Patent
Detmers et al.

(10) Patent No.: US 6,951,172 B2
(45) Date of Patent: Oct. 4, 2005

(54) ACCESSORY FOR A PRINTING UNIT

(75) Inventors: Andreas Detmers, Mauer (DE); Arno Jünger, Nussloch (DE); Jürgen Kreutzkämper, Sinsheim-Hoffenheim (DE); Sven Mader, Dielheim (DE); Christian Meier, Schriesheim (DE); Gotthard Schmid, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/902,550

(22) Filed: Jul. 10, 2001

(65) Prior Publication Data

US 2002/0005133 A1 Jan. 17, 2002

Related U.S. Application Data

(63) Continuation-in-part of application No. 09/283,821, filed on Mar. 31, 1999, now Pat. No. 6,510,795.

(30) Foreign Application Priority Data

Mar. 31, 1998 (DE) ..... 198 14 661
Sep. 13, 1999 (DE) ..... 199 47 281

(51) Int. Cl.[7] ..... B41F 35/00; B41F 35/06; B41F 7/20

(52) U.S. Cl. ..... 101/480; 101/424.1

(58) Field of Search ..... 101/480; 430/204, 430/205, 300–310

(56) References Cited

U.S. PATENT DOCUMENTS

| | | | | |
|---|---|---|---|---|
| 3,611,923 A | * | 10/1971 | Haramia et al. | 101/93.28 |
| 4,449,453 A | | 5/1984 | Staffer et al. | 101/424.1 |
| 4,572,069 A | | 2/1986 | Schwarzbeck | 101/76 |
| 4,723,487 A | | 2/1988 | Richardson | 101/126 |

(Continued)

FOREIGN PATENT DOCUMENTS

| | | | | |
|---|---|---|---|---|
| DE | 31 43 089 C2 | | 5/1983 | |
| DE | 84 34 012.6 | | 2/1985 | |
| DE | 34 07 681 C2 | | 9/1985 | |
| DE | 35 25 743 A1 | | 1/1987 | |
| DE | 39 23 362 C2 | | 2/1990 | |
| DE | 38 37 898 A1 | | 6/1990 | |
| DE | 41 18 697 C2 | | 12/1992 | |
| DE | 42 18 422 C2 | | 12/1993 | |
| DE | 94 05 223.9 | | 7/1994 | |
| DE | 44 43 516 C1 | | 4/1996 | |
| DE | 296 17 261 U1 | | 11/1996 | |
| EP | 0 741 025 A2 | | 11/1996 | |
| GB | 2 150 079 A | | 6/1985 | |
| JP | 61248834 A | * | 11/1986 | ..... B65H/3/44 |
| JP | 05077412 A | * | 3/1993 | ..... B41F/35/06 |

OTHER PUBLICATIONS

Machine translation of JP 5–77412 to Kumaki et al. from Japanese Patent Office website.*

*Primary Examiner*—Daniel J. Colilla
(74) *Attorney, Agent, or Firm*—Laurence A. Greenberg; Werner H. Stemer; Ralph E. Locher

(57) ABSTRACT

A printing unit configuration includes an accessory and a connection mechanism moveably fastening the accessory thereto, throwing the accessory thereon into a working position, and removing it therefrom into maintenance positions. A linear guide can be connected to the accessory and disposed perpendicular to a pivot axis, with the mechanism pivoting the accessory away from the unit about the axis and displacing it along the guide. The mechanism can have two pivot axes disposed parallel to the unit rotation axis and can pivot the accessory away from the unit first about the first axis then about the second. The mechanism can pivot the accessory about an axis perpendicular to the unit rotation axis and/or about a single pivot axis disposed below the accessory. The mechanism can connect the accessory to the unit to project into a recess of a side wall of the printing machine at a side opposite an operator side in a maintenance position.

70 Claims, 5 Drawing Sheets

U.S. PATENT DOCUMENTS 4,727,807 A 3/1988 Suzuki et al. ..... 101/415.1
4,934,264 A * 6/1990 Gansky et al. ..... 101/175
4,967,658 A * 11/1990 Townsend ..... 101/175
5,072,671 A 12/1991 Schneider et al. ..... 101/467
5,289,775 A * 3/1994 Spiegel et al. ..... 101/477
5,333,545 A 8/1994 Ganter et al. ..... 101/76
5,406,888 A * 4/1995 Sugiyama et al. ..... 101/415.1
5,421,260 A * 6/1995 Döbler ..... 101/247
5,479,858 A * 1/1996 Beisel et al. ..... 101/477
5,537,926 A * 7/1996 Beisel et al. ..... 101/477
5,562,038 A * 10/1996 Bierbaum et al. ..... 101/483
5,575,212 A * 11/1996 Moser et al. ..... 101/477
5,615,612 A * 4/1997 Guba et al. ..... 101/425
5,630,363 A 5/1997 Davis et al. ..... 101/141
5,644,980 A 7/1997 Kusch et al. ..... 101/72
5,893,323 A 4/1999 Ishii ..... 101/116
5,996,490 A 12/1999 Baureis et al. ..... 101/216
6,142,072 A * 11/2000 Rudewitz et al. ..... 101/216
6,182,572 B1 * 2/2001 McKillip ..... 101/494

* cited by examiner

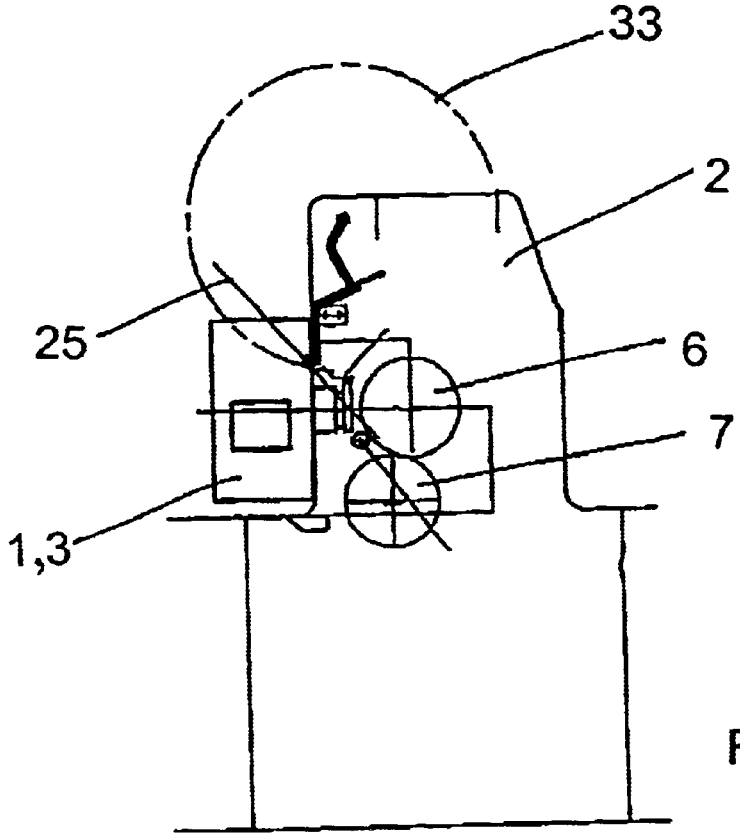
Fig. 6a
Fig. 6b
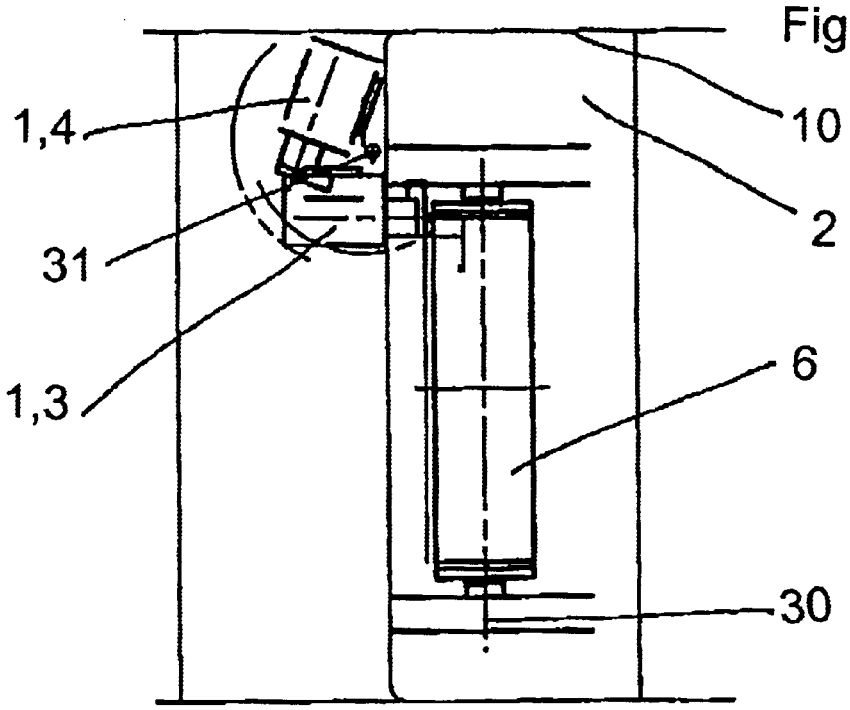

ACCESSORY FOR A PRINTING UNIT

CROSS-REFERENCE TO RELATED APPLICATION

This application is a continuation-in-part application of U.S. patent application Ser. No. 09/283,821, filed Mar. 31, 1999 now U.S. Pat. No. 6,510,795, which application is hereby incorporated herein by reference.

BACKGROUND OF THE INVENTION

Field of the Invention

The invention relates to an accessory for a printing unit. The accessory is thrown onto the printing unit in a working position and is removed from the region of the printing unit in at least one maintenance position. The accessory can be fastened to the printing machine by a pivoting mechanism.

It is often not possible for accessories to be installed permanently in printing units because the construction space therein, above all in the case of offset printing machines, is required for numerous printing unit components that are necessary, such as the inking unit and, as a rule, also the dampening unit. Therefore, there is a need for having accessories that can be selectively thrown on, but also removed for maintenance work or for changing the printing plate or ink, so that these necessary tasks can be carried out on the printing unit.

U.S. Pat. No. 5,630,363 to Davis et al. proposes disposing an accessory on a pivoting arm fastened on the top side of the printing unit, so that the accessory can be pivoted over the printing unit. The disadvantage of such a solution, however, is that space is often not available on the top side of the printing unit because other devices are already located there or space has to be kept free for these. Moreover, the proposed solution impedes access to the inking unit and may collide with printing plate changing devices. Such upward pivoting of an accessory requires a large amount of space above the machine and could not be used in low rooms.

Another prior art proposal is to pivot the accessory into a vertical position to the side. However, because most accessories have to reach into the printing unit, such a proposal can be used for only a few applications. Just like the pivoting travel proposed by Davis et al., the pivoting travel into the vertical position takes up a large amount of time, especially because, for many tasks such as changing the printing plate, it would be sufficient to remove the accessory only a small distance from the printing unit.

European Patent Application 0 741 025 A2 discloses a pivoting device for a coating system engaging into a printing unit. The coating system is pivotable on a pivoting arm about a pivot axis disposed above the printing units and, furthermore, is pivotable relative to the pivoting arm itself about a further pivot axis. During the pivoting of the coating system about the pivot axis disposed on the top side of the printing units, the coating system obviously always remains in the same vertical orientation, made possible by the pivot axis at the end of the pivoting arm. One disadvantage, here, is that the coating system projecting at least partially into the printing unit must be at a sufficient vertical distance from the printing units so that such movement is possible.

German Utility Model G 296 17 261 U discloses a sheet-fed rotary printing machine having an inking unit that is pivotable out of an inking position into a working position. The inking unit is pivotably mounted on side stands of the lacquering unit through a lever device such that the inking unit is simultaneously moved away from the printing unit and upward.

German Utility Model G 94 05 223 U discloses a drier device for a sheet-fed rotary printing machine. The drier device can be guided in the vertical direction by a guide mechanism past a sheet-guiding cylinder and an associated form cylinder. In particular, the distance from the cylinder can be set according to requirements. In addition to a linear displacement of the drier device by screw mechanisms, it describes a configuration with two four-bar linkages that are mounted fixedly relative to the stand and may be executed in the form of a crank-and-rocker mechanism or parallel crank, so that the drier device is pivoted.

Furthermore, German Patent DE 41 18 697 C2 discloses a device for changing the ink in inking units of multicolor rotary printing machines, with at least two ink supply units that are guided transversely to the inking unit along the machine side walls, and are capable of being moved between an active position located at the inking-unit side and intended for ink conveyance and a remote passive position. The units are connected freely rotatably and in a pod-like manner, at least on one side, through a pivoting bolt forming a suspension, to one end of a pivoting beam parallel to a machine side wall. The pivoting beam is fastened rotatably to a linear guide displaceable along a machine side wall so that the units do not tilt during the pivoting operation of the pivoting beam. In such a case, a linear movement away from the printing unit first takes place, which is then followed by a rotational movement for interchanging the units.

SUMMARY OF THE INVENTION

As already described in German patent application 198 14 661.2, corresponding to U.S. patent application Ser. No. 09/283,821, an object on which the invention is based is to develop an accessory of the type initially mentioned such that it can be brought within the shortest possible time into a region of the printing machine in which it does not disturb the tasks to be carried out on the printing unit and in which the necessary space is available and also does not have to be kept free for further accessories.

Among the embodiments dealt with in German patent application 198 14 661.2, an accessory is described in which the pivoting mechanism is disposed in a region of the side wall of the printing unit such that the accessory can be brought into a vertical position next to the side wall. At least one linear guide is disposed in front of the side wall such that the accessory can be displaced into a horizontal position removed from the printing unit. It is possible, by such a solution, to bring the accessory into one of two standby positions, as required. A horizontal displacement of the accessory is sufficient for many tasks on the printing unit, in particular, for changing the printing plate. As a result of the horizontal displacement, the accessory is moved away from the cylinders parallel to these. If a further printing unit follows in the case of a multicolor printing machine, the accessory is moved into the aisle between the printing units. Horizontal displacement requires only an extremely short time, so that the machine stoppage time, for example, for changing the printing plate, is not extended, and, therefore, there is no detriment to the viability of the machine. For major maintenance work, such as the cleaning of the printing unit, changing the rubber blanket, etc., the accessory can be brought into a region in which it is completely out of the way for these tasks and in which neither problems of collision with other accessories arise nor is the space occupied by these have to be kept free for them. The proposal does not give rise to any further space requirement above a printing unit, so that it is possible to maintain a machine height of approximately 2.60 m, even in the case of large printing machines, so that they can be used even in printing shops with a low ceiling height. Because both horizontal displacement and pivoting of the accessory are possible, there is no problem when an accessory engages into the printing unit.

The solution affords the possibility that the accessory, before being pivoted into the vertical position, is displaced horizontally at least until it no longer engages into the printing unit.

It is accordingly an object of the invention to provide an accessory for a printing unit that overcomes the hereinaforementioned disadvantages of the heretofore-known devices of this general type.

With the foregoing and other objects in view, there is provided, in accordance with the invention, an accessory configuration for a printing unit of a printing machine according to German patent application 198 14 661.2, the configuration including an accessory, a connection mechanism having a pivot axis, and a linear guide connected to the accessory and disposed perpendicular to the pivot axis. The connection mechanism moveably fastens the accessory to a printing unit of a printing machine, pivots the accessory away from the printing unit about the pivot axis and displaces the accessory along the linear guide, and throws the accessory onto the printing unit into a working position and removes the accessory from a region of the printing unit into at least one maintenance position.

With the objects of the invention in view, there is also provided an accessory configuration for a printing unit of a printing machine according to German patent application 198 14 661.2, the printing unit having a rotation axis, the accessory configuration including an accessory and a connection mechanism having a first pivot axis and a second pivot axis. The axes are disposed substantially parallel to a rotation axis of a printing unit of a printing machine. The connection mechanism moveably fastens the accessory to the printing unit, pivots the accessory away from the printing unit about the first pivot axis then allows further pivoting of the accessory about the second pivot axis, and throws the accessory onto the printing unit into a working position and removes the accessory from a region of the printing unit into at least one maintenance position.

With the objects of the invention in view, there is also provided an accessory configuration for a printing unit of a printing machine according to German patent application 198 14 661.2, the printing unit having a rotation axis, the accessory configuration including an accessory and a connection mechanism having a pivot axis. The pivot axis is disposed substantially perpendicular to a rotation axis of a printing unit of a printing machine. The connection mechanism moveably fastens the accessory to the printing unit, pivots the accessory about the pivot axis, and throws the accessory onto the printing unit into a working position and removes the accessory from a region of the printing unit into at least one maintenance position.

With the objects of the invention in view, there is also provided an accessory configuration for a printing unit of a printing machine according to German patent application 198 14 661.2, including an accessory and a connection mechanism having a single pivot axis disposed below the accessory. The connection mechanism moveably fastens the accessory to a printing unit of a printing machine, pivots the accessory about the single pivot axis, and throws the accessory onto the printing unit into a working position and removes the accessory from a region of the printing unit into at least one maintenance position.

With the objects of the invention in view, there is also provided an accessory configuration for a printing unit of a printing machine according to German patent application 198 14 661.2 having a side opposite a printing machine operator and a side wall disposed at the side opposite a printing machine operator, the side wall having a recess, the accessory configuration including an accessory and a connection mechanism moveably fastening the accessory to a printing unit of a printing machine, throwing the accessory onto the printing unit into a working position and removing the accessory from a region of the printing unit into at least one maintenance position, and connecting the accessory to the printing unit such that the accessory at least partially projects into a recess of a side wall of the printing machine in a maintenance position.

The invention is intended to develop an accessory such that it can be brought within the shortest possible time into a region of the printing machine in which it does not disturb the tasks to be carried out on a printing unit and in which the necessary space is available and also does not have to be kept free for further accessories. The accessory can be pivoted through one or more pivot axes and can be moved into a position in the region of the side wall.

Such accessories are advantageous particularly when the accessory projects at least partially into the printing unit or into parts thereof. The accessory is disengaged from the printing unit by a pivoting movement.

In accordance with another feature of the invention, the printing unit has parts; and the accessory projects at least partially into one of the printing unit and the parts of the printing unit.

In accordance with a further feature of the invention, the accessory is an exposure unit having a guide executed along the width of the printing unit and an exposure head displaceable along the guide.

If the accessory is an exposure unit having a guide executed along the width of the printing unit and an exposure head that is displaceable along the guide, sufficient space can be produced in a simple way to allow those plates to be exposed to be introduced and taken out.

In accordance with an added feature of the invention, there is provided a centering device or means for exactly centering the accessory in the working position.

In accordance with an additional feature of the invention, there is provided a locking device or means for locking the accessory in a centered position with a holding force.

Particularly when the accessories are imaging devices, such accessories must be positioned with extreme accuracy, so that such imaging coincides with the machine register. It is, therefore, proposed that the accessory be capable of being positioned exactly in the working position by a centering device or means. There may also be provision for a locking device or means to detain the accessory in the centered position with a holding force. Such a configuration rules out any relative movement between the imaging device and, for example, the plate cylinder, and even vibrations cannot lead to such relative movement.

In accordance with yet another feature of the invention, the centering device or means has a prism and at least one bolt engaging the prism.

In accordance with yet a further feature of the invention, the centering device or means has at least one stop.

In one embodiment, the centering device has at least one bolt engaging into a prism. As a result of the horizontal orientation of the prism and bolt, exact horizontal positioning can be achieved. Such positioning is particularly important in the case of imaging units. For exact orientation in the vertical, there may be provision for the centering device to additionally have at least one stop. The stop is expediently spaced from the prism in the vertical direction.

In accordance with yet an added feature of the invention, centering device or means has at least one contact face and the locking device or means is at least one pneumatic element pressing the accessory against the at least one contact face.

In accordance with a concomitant feature of the invention, there is provided a spring connected to the connection mechanism for assisting the pivoting movement.

If the embodiments are accessories that engage into the printing unit, it is expedient to enable pivoting into the vertical position only when the accessory is displaced to an extent such that it no longer engages into the printing unit.

In an essential application, the accessory is an imaging device that is thrown onto the plate cylinder in the working position. Such imaging devices may include a laser exposure unit of the plate cylinder, but also a device that is disposed on the rubber blanket cylinder or impression cylinder, to make impressions in the printed sheets, for example, in the form of serial numbers or other impressions specific to the individual prints. Such a purpose may be served, for example, by an inkjet unit or a numbering unit. It is, however, also possible, of course, to provide other accessories for a printing unit, for example, an additional inking or lacquering unit, a drier, or measuring systems in the form of measuring beams, for example, for register or ink measurement.

Other features that are considered as characteristic for the invention are set forth in the appended claims.

Although the invention is illustrated and described herein as embodied in an accessory for a printing unit, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 6*a* is a side elevational view of a third embodiment of the accessory and printing unit according to FIG. 4;

FIG. 6*b* is a plan elevational view of the accessory and printing unit according to FIG. 6*a*.

DESCRIPTION OF THE PREFERRED EMBODIMENTS

Figure 1:
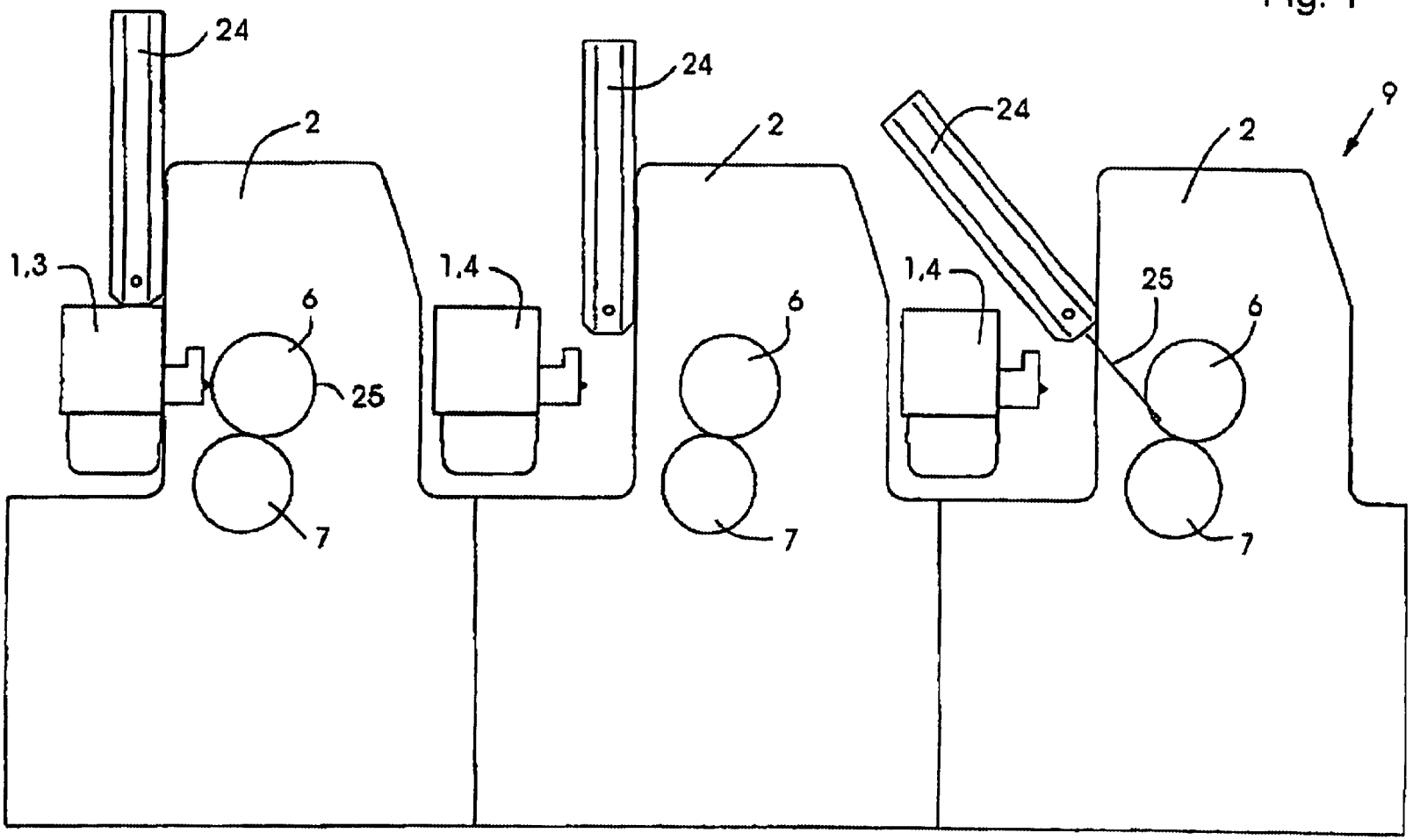
FIG. 1 is a side elevational view of a first exemplary embodiment according to German patent application 198 14 661.2 of a printing machine with an accessory and a printing plate changing device according to the invention in various working positions.

In all the figures of the drawing, sub-features and integral parts that correspond to one another bear the same reference symbol in each case.

Referring now to the figures of the drawings in detail and first, particularly to FIG. 1 thereof, there is shown a side view of a printing machine 9 according to an exemplary embodiment of German patent application 198 14 661.2. Three printing units 2 of the printing machine 9 are illustrated. An accessory 1 is depicted both in its working position 1, 3 and in its maintenance position 1, 4. Of course, it assumes one position or the other. Such an accessory 1 may be assigned to a specific or else to any desired printing unit 2 of the printing machine 9. In the working position 3, the accessory 1 can carry out tasks on a cylinder, for example, on the plate cylinder 6 or on the rubber blanket cylinder 7. The example illustrated relates to an accessory 1, for example, a laser unit, that images a printing plate 25 located on the plate cylinder 6. To carry out a printing plate change, it is sufficient if the accessory 1 is displaced a small distance horizontally rearward into a maintenance position 4. It is clear from the depicted printing plate 25 what space has to be freed for such a printing plate change.

In German published, non-prosecuted patent application DE 198 14 661 A1, corresponding to U.S. Pat. No. 6,510,795 and U.S. Patent Application Publication No. 2002/005133 A1, a second maintenance position is the vertical position that the accessory 1 must assume in order to allow major tasks on the printing unit 2 to be carried out. A linear guide serves for horizontal displacement and a pivoting mechanism serves for pivoting into the vertical position.

The printing machine 9 according to FIG. 1 is equipped with an accessory 1 and with a printing plate changing device 24, shown on the three printing units 2 in different working positions. In the left printing unit 2, the accessory 1 is in its working position 3. In the working position 3, the accessory 1 images the printing plate 25 on the plate cylinder 6, for example, by a laser. In the case of the middle printing unit 2, the accessory 1 has been displaced into a horizontal maintenance position 4, for example, to initiate a printing plate change. The right printing unit 2 indicates how the automatic printing plate changer 24 is in its printing plate changing position, in which it takes off a printing plate 25 from the plate cylinder 6 or delivers a printing plate 25 to the plate cylinder 6.

Clear from the illustration is how a horizontal displacement of the accessory 1 is sufficient to make possible the carrying out of a printing plate change, for example, by an automatic printing plate changer 24 or else a semiautomatic printing plate changer. There are, of course, also other tasks for which the displacement into the horizontal maintenance position 4 is sufficient. Only for major servicing work, such as, for example, in the case of a rubber blanket change or cleaning of the printing unit, does the accessory 1 have to be moved into the second maintenance position.

Figure 2:
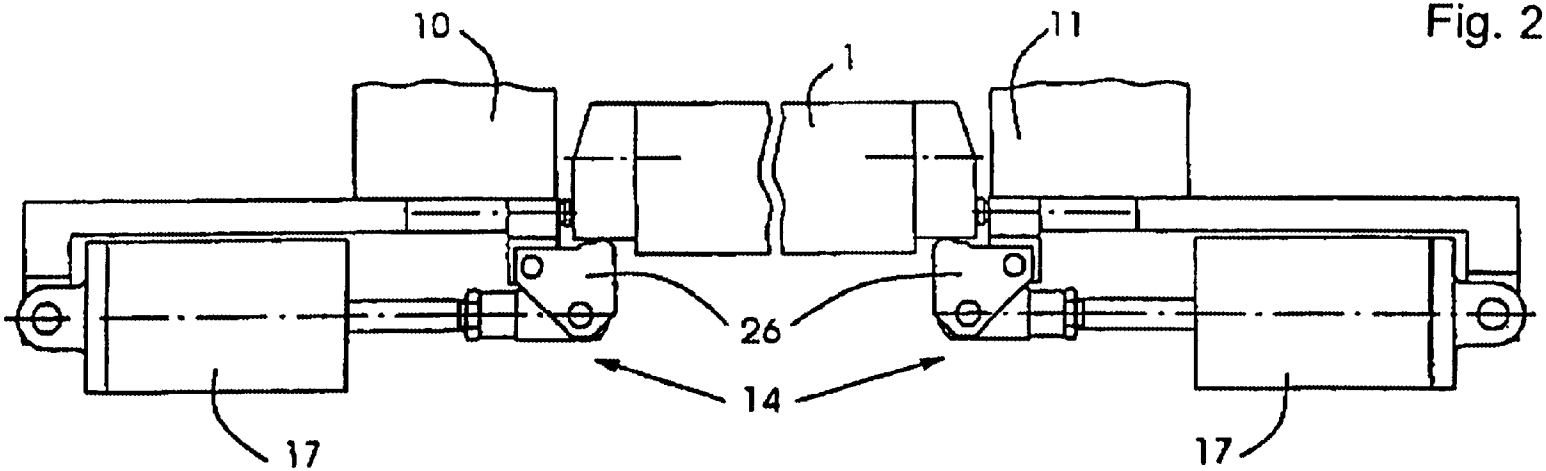
FIG. 2 is a fragmentary, plan elevational view of a centering device and lock according to the invention.

FIG. 2 shows a top view of a centering device or means 13 and lock or locking means 14. Pneumatic elements 17 are disposed on both sides of the accessory 1 on the side walls 10 and 11. The pneumatic elements respectively act on tension levers 26 and, thereby, serve as a lock 14. The tension levers 26 may be articulated on the side walls 10 and 11 and, by virtue of the dimensioning of the levers, serve for force intensification.

Figure 3:
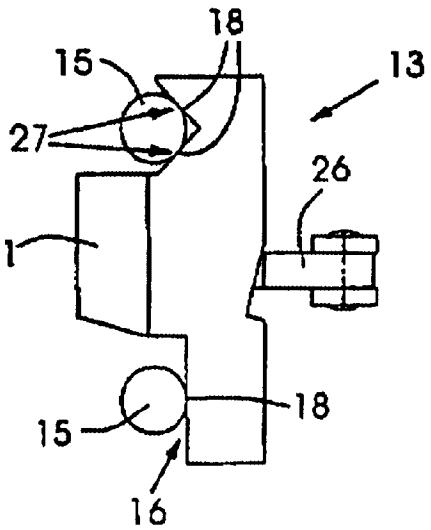
FIG. 3 is a side elevational view of the centering device and lock according to FIG. 2.

FIG. 3 shows the functioning of the lock 14, by which bolts 15 disposed on the machine are pressed against contact faces 18 of a centering device 13. The upper bolt 15 is pressed into the contact faces 18 of a prism 27, resulting in the exact positioning of the accessory 1. A stop 16 with a bolt 15 and with a straight contact face 18 in the lower region serves also for ensuring the vertical orientation of the accessory 1. Exact positioning of the accessory 1 is achieved thereby and an imaging device for respective imaging is positioned accurately in the machine register. The horizontal working positions, for example, of the laser beam, must be obtained by a horizontal regulating device for the latter. The regulating device is adjusted relative to the side wall by at least one sensor.

The centering device 13 and lock 14 illustrated above are merely one exemplary embodiment, and numerous other locking means may be envisaged. Essential is that accessory 1 is positioned exactly in terms of height and vertical orientation so that work can be carried out in accordance with the machine register.

Figure 4:
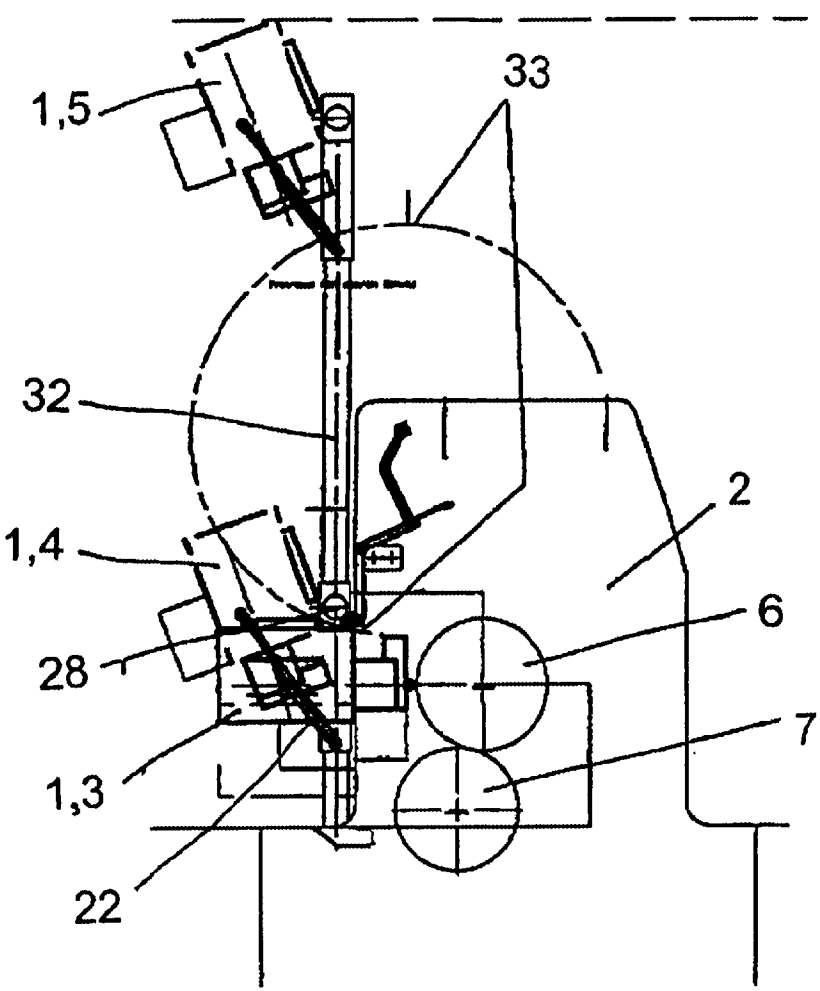
FIG. 4 is a side elevational view of an embodiment of the accessory and a printing unit according to the invention.

FIG. 4 shows a side view of an exemplary embodiment according to the invention, in which it is clear that the accessory 1 bears, in its working position 3, against the printing unit 2 having the impression cylinders 6, 7 and engages at least partially into the printing unit 2. To carry out maintenance work, it is necessary to bring the accessory 1 from the printing unit 2 into a maintenance position 1, 5. The movement is carried out by pivoting the accessory 1 about a first pivot axis 28, which is parallel to the center axis of the impression cylinders 6, 7, such that it is not engaged into the printing unit 2. The accessory is subsequently displaced into the upper maintenance position 1, 5 along a linear guide 32 that is perpendicular to the pivot axis 28. It may be gathered from the semicircle 33 depicted by broken lines that the upper guard of the printing unit 2 is freely movable, so that tasks can be carried out on the impression cylinders. The linear guide 32 is, in this case, disposed laterally of the upper guard.

Figure 5:
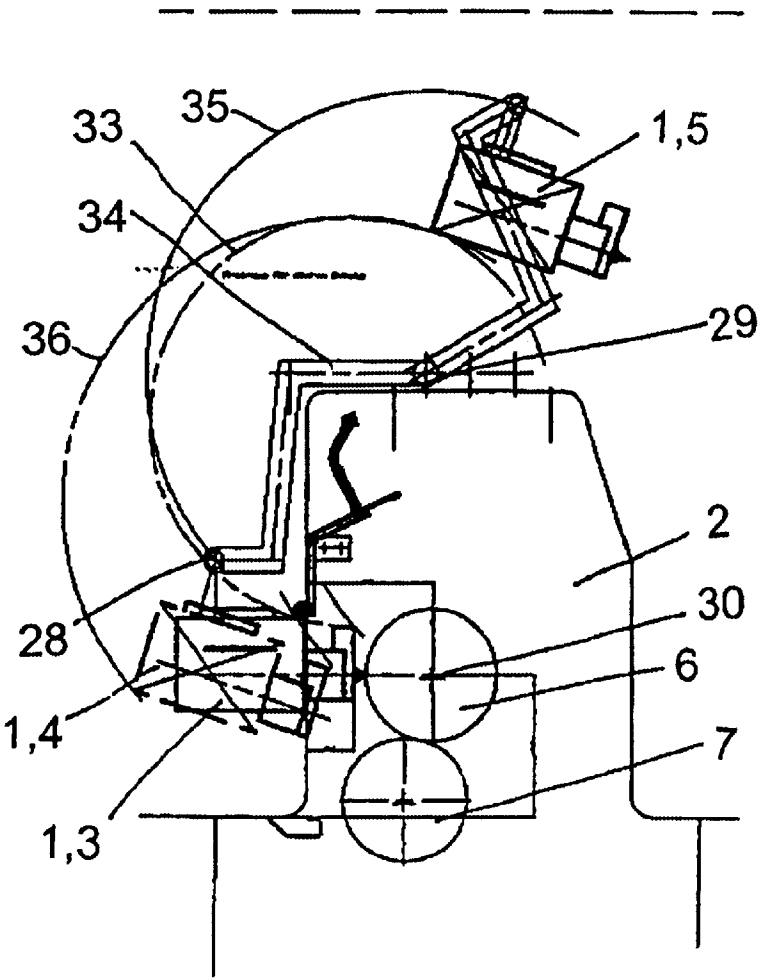
FIG. 5 is a side elevational view of a second embodiment of the accessory and printing unit according to FIG. 4.

FIG. 5 shows a further exemplary embodiment of the invention, in which the accessory 1 is again thrown onto the printing unit 2 in a working position 1, 3. The accessory 1 can be pivoted away from the printing unit 2 through a pivot axis 28, so that further pivoting about a second pivot axis 29 is possible. The pivot axis 29 is disposed above the printing unit 2 and the two pivot axes 28, 29 are essentially parallel to the axis of rotation 30 of the printing unit 2 or of the cylinders 6, 7. The accessory 1 can be brought out of the working position 3 into a first position 1, 4 by tilting about the pivot axis 28, the accessory still continuing to engage into the printing unit 2. The pivot 28 is connected to the second pivot axis 29 by a pivoting arm 34. The pivot axis 28 travels along on the circle arc 35 during pivoting about the second pivot axis 29. During the pivoting of the pivoting arm 34, the accessory 1 remains in a predetermined spatial orientation, which corresponds to the first maintenance position 4, and is, thus, rotated about the pivot axis 28 during the raising of the pivoting arm 34. The circle arc 36 shows the movement of the lower edges of the accessory, the geometric conditions of the pivoting arm 34, and of the configuration of the pivot axes 28 and 29 being selected such that, on one hand, pivoting of the still partially engaged accessory 1 is possible without disturbance by the printing unit 2, and such that, on the other hand, the upper guard, the pivoting range of which is indicated by the circle arc 33, can still be opened. In the maintenance position 1, 5, the accessory is located above the printing unit 2.

FIG. 6*a* illustrates a further exemplary embodiment, in which the accessory 1 is thrown on in a working position 3 of a printing unit 2. The accessory 1 is pivotable about a pivot axis 31 that is oriented essentially perpendicularly to the axis of rotation 30 of the printing unit 2, as is clear from FIG. 6*b*. The pivot axis 31 is disposed in the region of the side wall 10 on a side facing away from the operator. Pivoting is carried out over an angle greater than 90°. By the large pivoting angle, the accessory 1, partially engaged into the printing unit 2, is removed sufficiently far from the upper guard, so that the upper guard can be moved freely along the circle arc 33.

Figure 7:
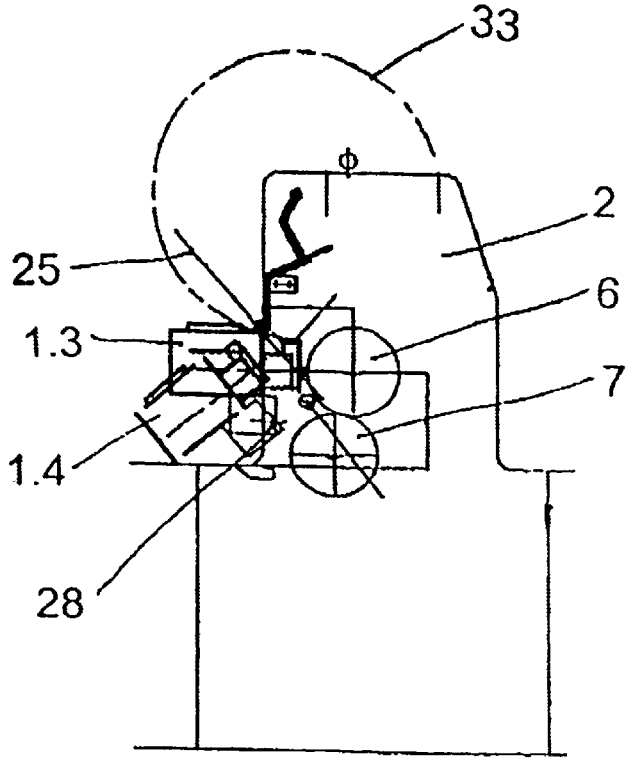
FIG. 7 is a fourth embodiment of the accessory and printing unit according to FIG. 4.
Figure 8:
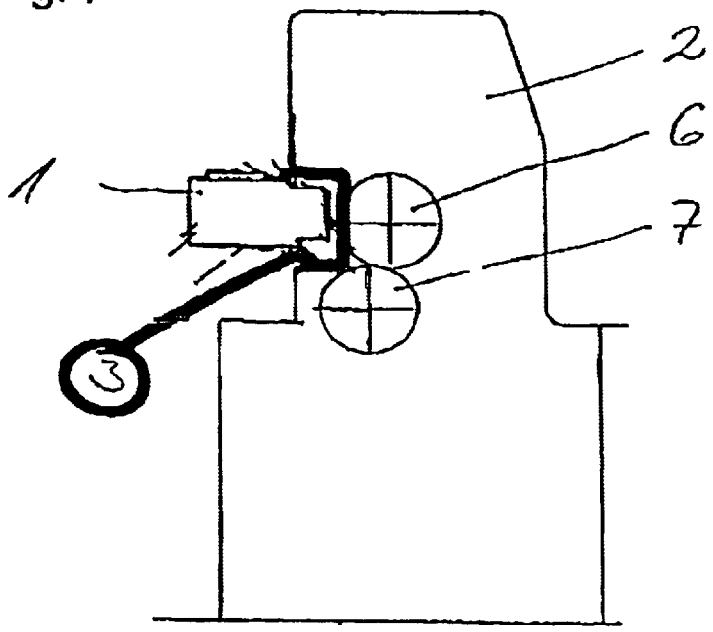
FIG. 8 is a fifth embodiment of the accessory and printing unit according to FIG. 4.

FIG. 7 illustrates a printing unit 2 with an accessory 1 that is thrown onto the printing unit in a working position 3. The accessory 1 is pivotable about a pivot axis 28 disposed below the accessory. As a result of the downward pivoting, the upper guard can be moved freely along the circle arc 33, and, in such a position, it is also readily possible to introduce, for example, a printing plate 25, because, in the position 1, 4, the accessory 1 allows sufficient access to the impression cylinders 6, 7.

Expediently, in the exemplary embodiments, a spring, for example a pneumatic spring 22, may be provided. The spring 22 has been illustrated only in FIG. 4 for the sake of simplicity.

An embodiment in which the accessory 1 is pivoted out of the working position into a maintenance position and is then moved into a recess of the side wall 10 is not illustrated, but is envisioned. Such is possible when the recess in the side wall can be provided without any stability problems. In such a case, the side wall is disposed on that side of the printing machine that is opposite the operator, so that free access to the printing unit becomes possible.

We claim:

1. An accessory configuration for a printing unit of a printing machine, comprising:

an accessory selected from the group consisting of an imaging device, an ink-jet unit, a varnishing mechanism, a dryer, and a measuring device;

a connection mechanism moveably fastening said accessory to the printing unit, said connection mechanism having a horizontal pivot axis;

a linear guide connected to said accessory and disposed perpendicular to said horizontal pivot axis; and said connection mechanism pivoting said accessory away from the printing unit about said horizontal pivot axis and then displacing said accessory vertically along said linear guide for moving said accessory from a working position into at least one maintenance position.

2. The accessory according to claim 1, wherein:

the printing unit has parts; and the accessory projects at least partially into one of the printing unit and the parts of the printing unit.

3. The accessory according to claim 1, wherein:

the printing unit has a width; and said accessory is an exposure unit having:

a guide executed along the width of the printing unit; and an exposure head displaceable along said guide.

4. The accessory according to claim 1, including a means for exactly centering said accessory in the working position.

5. The accessory according to claim 4, including a means for locking said accessory in a centered position with a holding force.

6. The accessory according to claims 5, wherein:

said centering means has at least one contact face; and said locking means is at least one pneumatic element pressing said accessory against said at least one contact face.

7. The accessory according to claim 4, wherein said centering means has a prism and at least one bolt engaging said prism.

8. The accessory according to claim 4, wherein said centering means has at least one stop.

9. The accessory according to claim 1, including a centering device for exactly centering said accessory in the working position.

10. The accessory according to claim 9, including a lock detaining said accessory in a centered position with a holding force.

11. The accessory according to claims 10, wherein:

said centering device has at least one contact face; and said locking means is at least one pneumatic element pressing said accessory against said at least one contact face.

12. The accessory according to claim 9, wherein said centering device has a prism and at least one bolt engaging said prism.

13. The accessory according to claim 9, wherein said centering device has at least one stop.

14. The accessory according to claim 1, including a spring connected to said connection mechanism for assisting the pivoting movement.

15. An accessory configuration for a printing unit of a printing machine, the printing unit having a rotation axis and a width, the accessory configuration comprising:

an accessory;

a connection mechanism moveably fastening said accessory to the printing unit, said connection mechanism having a first pivot axis and a second pivot axis, said first pivot axis and said second pivot axis disposed outside of the printing unit and disposed substantially parallel to a rotation axis of the printing unit, said second pivot axis disposed above the printing unit;

said connection mechanism:

pivoting said accessory away from the printing unit about said first pivot axis then allowing further pivoting of said accessory about said second pivot axis; and throwing said accessory onto the printing unit into a working position and removing said accessory from a region of the printing unit into at least one maintenance position; and said accessory being an exposure unit having:

a guide executed along the width of the printing unit; and an exposure head displaceable along said guide.

16. The accessory according to claim 15, wherein:

the printing unit has parts; and the accessory projects at least partially into one of the printing unit and the parts of the printing unit.

17. The accessory according to claim 15, including a means for exactly centering said accessory in the working position.

18. The accessory according to claim 17, including a means for locking said accessory in a centered position with a holding force.

19. The accessory according to claim 17, wherein said centering means has a prism and at least one bolt engaging said prism.

20. The accessory according to claim 17, wherein said centering means has at least one stop.

21. The accessory according to claim 15, including a centering device for exactly centering said accessory in the working position.

22. The accessory according to claim 21, including a lock detaining said accessory in a centered position with a holding force.

23. The accessory according to claim 21, wherein said centering device has a prism and at least one bolt engaging said prism.

24. The accessory according to claim 21, wherein said centering device has at least one stop.

25. The accessory according to claim 15, including a spring connected to said connection mechanism for assisting the pivoting movement.

26. An accessory configuration for a printing unit of a printing machine, the printing unit having a rotation axis, the accessory configuration comprising:

an accessory;

a connection mechanism moveably fastening said accessory to the printing unit, said connection mechanism having a first pivot axis and a second pivot axis, said first pivot axis and said second pivot axis disposed outside of the printing unit and disposed substantially parallel to the rotation axis of the printing unit, said second pivot axis disposed above the printing unit;

a means for exactly centering said accessory in the working position;

a means for locking said accessory in a centered position with a holding force;

said connection mechanism:

pivoting said accessory away from the printing unit about said first pivot axis then allowing further pivoting of said accessory about said second pivot axis; and throwing said accessory onto the printing limit into a working position and removing said accessory from a region of the printing unit into at least one maintenance position;

said centering means having at least one contact face; and said locking means being at least one pneumatic element pressing said accessory against said at least one contact face.

27. An accessory configuration for a printing unit of a printing machine, the printing unit having a rotation axis, the accessory configuration comprising:

an accessory;

a connection mechanism moveably fastening said accessory to the printing unit, said connection mechanism having a first pivot axis and a second pivot axis, said first pivot axis and said second pivot axis disposed outside of the printing unit and disposed substantially parallel to a rotation axis of the printing unit, said second pivot axis disposed above the printing unit;

said connection mechanism:

pivoting said accessory away from the printing unit about said first pivot axis then allowing further pivoting of said accessory about said second pivot axis; and throwing said accessory onto the printing unit into a working position and removing said accessory from a region of the printing unit into at least one maintenance position;

a centering device for exactly centering said accessory in the working position;

a lock detaining said accessory in a centered position with a holding force;

said centering device having at least one contact face; and said lock being at least one pneumatic element pressing said accessory against said at least one contact face.

28. An accessory configuration for a printing unit of a printing machine, the printing unit having a width and a rotation axis, the accessory configuration comprising:

an accessory having a guide executed along the width of the printing unit, said accessory having a head displaceable along said guide, said accessory being selected from the group consisting of an imaging device, an ink-jet unit, a varnishing mechanism, a dryer, and a measuring device;

a connection mechanism moveably fastening said accessory to the printing unit, said connection mechanism having a pivot axis at one end of said guide, said pivot axis disposed substantially perpendicular to the rotation axis of the printing unit, said connection mechanism pivoting said accessory about said pivot axis for moving said accessory from a working position into at least one maintenance position.

29. The accessory according to claim 28, wherein:

the printing unit has parts; and the accessory projects at least partially into one of the printing unit and the parts of the printing unit.

30. The accessory according to claim 28, wherein:

the printing unit has a width; and said accessory is an exposure unit having:

a guide executed along the width of the printing unit; and an exposure head displaceable along said guide.

31. The accessory according to claim 28, including a means for exactly centering said accessory in the working position.

32. The accessory according to claim 31, including a means for locking said accessory in a centered position with a holding force.

33. The accessory according to claims 32, wherein:

said centering means has at least one contact face; and said locking means is at least one pneumatic element pressing said accessory against said at least one contact face.

34. The accessory according to claim 31, wherein said centering means has a prism and at least one bolt engaging said prism.

35. The accessory according to claim 31, wherein said centering means has at least one stop.

36. The accessory according to claim 28, including a centering device for exactly centering said accessory in the working position.

37. The accessory according to claim 36, including a lock detaining said accessory in a centered position with a holding force.

38. The accessory according to claims 37, wherein:

said centering device has at least one contact face; and said locking means is at least one pneumatic element pressing said accessory against said at least one contact face.

39. The accessory according to claim 36, wherein said centering device has a prism and at least one bolt engaging said prism.

40. The accessory according to claim 36, wherein said centering device has at least one stop.

41. The accessory according to claim 28, including a spring connected to said connection mechanism for assisting the pivoting movement.

42. An accessory configuration for a printing unit of a printing machine, comprising:

an accessory selected from the group consisting of an imaging device, an ink-jet unit, a varnishing mechanism, a dryer, and a measuring device;

a connection mechanism moveably fastening said accessory to the printing unit, said connection mechanism having a single horizontal pivot axis disposed below said accessory, said connection mechanism pivoting said accessory about said single horizontal pivot axis for moving said accessory from a working position into at least one maintenance position.

43. The accessory according to claim 42, wherein:

the printing unit has parts; and the accessory projects at least partially into one of the printing unit and the parts of the printing unit.

44. The accessory according to claim 42, wherein:

the printing unit has a width; and said accessory is an exposure unit having:

a guide executed along the width of the printing unit; and an exposure head displaceable along said guide.

45. The accessory according to claim 42, including a means for exactly centering said accessory in the working position.

46. The accessory according to claim 45, including a means for locking said accessory in a centered position with a holding force.

47. The accessory according to claims 46, wherein:

said centering means has at least one contact face; and said locking means is at least one pneumatic element pressing said accessory against said at least one contact face.

48. The accessory according to claim 45, wherein said centering means has a prism and at least one bolt engaging said prism.

49. The accessory according to claim 45, wherein said centering means has at least one stop.

50. The accessory according to claim 42, including a centering device for exactly centering said accessory in the working position.

51. The accessory according to claim 50, including a lock detaining said accessory in a centered position with a holding force.

52. The accessory according to claims 51, wherein:

said centering device has at least one contact face; and said locking means is at least one pneumatic element pressing said accessory against said at least one contact face.

53. The accessory according to claim 50, wherein said centering device has a prism and at least one bolt engaging said prism.

54. The accessory according to claim 50, wherein said centering device has at least one stop.

55. The accessory according to claim 42, including a spring connected to said connection mechanism for assisting the pivoting movement.

56. An accessory configuration for a printing unit of a printing machine having a side opposite a printing machine operator and a side wall disposed at the side opposite a printing machine operator, the side wall having a recess formed therein, the accessory configuration comprising:

an accessory to be accommodated in the recess; and a connection mechanism moveably fastening said accessory to the printing unit for moving said accessory from a working position into at least one maintenance position, said connection mechanism connecting said accessory to the printing unit causing said accessory to at least partially project into the recess of the side wall of the printing machine in said maintenance position.

57. The accessory according to claim 56, wherein:

said connection mechanism is a pivoting mechanism; and said pivoting mechanism pivotably fastens said accessory to the printing machine.

58. The accessory according to claim 56, wherein:

the printing unit has parts; and the accessory projects at least partially into one of the printing unit and the parts of the printing unit.

59. The accessory according to claim 56, wherein:

the printing unit has a width; and said accessory is an exposure unit having:

a guide executed along the width of the printing unit; and an exposure head displaceable along said guide.

60. The accessory according to claim 56, including a means for exactly centering said accessory in the working position.

61. The accessory according to claim 60, including a means for locking said accessory in a centered position with a holding force.

62. The accessory according to claims 61, wherein:

said centering means has at least one contact face; and said locking means is at least one pneumatic element pressing said accessory against said at least one contact face.

63. The accessory according to claim 60, wherein said centering means has a prism and at least one bolt engaging said prism.

64. The accessory according to claim 60, wherein said centering means has at least one stop.

65. The accessory according to claim 56, including a centering device for exactly centering said accessory in the working position.

66. The accessory according to claim 65, including a lock detaining said accessory in a centered position with a holding force.

67. The accessory according to claims 66, wherein:

said centering device has at least one contact face; and said locking means is at least one pneumatic element pressing said accessory against said at least one contact face.

68. The accessory according to claim 65, wherein said centering device has a prism and at least one bolt engaging said prism.

69. The accessory according to claim 65, wherein said centering device has at least one stop.

70. The accessory according to claim 56, including a spring connected to said connection mechanism for assisting the pivoting movement.

* * * * *